United States Patent [19]

McGinnis

[11] Patent Number: 4,625,475

[45] Date of Patent: Dec. 2, 1986

[54] EXTENSIBLE MAST

[76] Inventor: Henry J. McGinnis, P.O. Box 7256, Fort Worth, Tex. 76111

[21] Appl. No.: 733,069

[22] Filed: May 13, 1985

[51] Int. Cl.[4] ..... E04H 12/00

[52] U.S. Cl. ..... 52/108; 52/111; 52/745; 242/54 A

[58] Field of Search ..... 52/108, 111, 745; 242/54 A

[56] References Cited

U.S. PATENT DOCUMENTS

| | | | |
|---|---|---|---|
| 980,157 | 12/1910 | Jaeger et al. | 254/1 |
| 2,130,993 | 9/1938 | Dubilier | 52/108 |
| 3,012,635 | 12/1961 | Blain | 187/19 |
| 3,213,573 | 10/1965 | Bohr et al. | 52/108 |
| 3,242,576 | 3/1966 | Wheeler | 33/293 |
| 4,237,662 | 12/1980 | Kinzler | 52/108 |
| 4,453,679 | 1/1984 | Thuries et al. | 242/54 A |

FOREIGN PATENT DOCUMENTS

| | | | |
|---|---|---|---|
| 547830 | 3/1932 | Fed. Rep. of Germany | 52/108 |
| 140091 | 1/1935 | Fed. Rep. of Germany | 52/108 |

*Primary Examiner*—John E. Murtagh
*Assistant Examiner*—Caroline Dennison
*Attorney, Agent, or Firm*—James E. Bradley

[57] ABSTRACT

An extensible mast is shown which is erected from a portable base having a plurality of tape reels mounted thereon. The tape reels are angularly oriented on the base with respect to a common, vertical axis, and each of the tape reels is adapted to receive a resilient metal tape having longitudinal edges for winding and unwinding the tape. A plurality of guide rollers on the base receive the respective longitudinal edges of the metal tapes and orient the tapes whereby the tapes are fed upwardly in planes parallel to the vertical axis and at an angle to each other to form a rigid structure. A geared winding mechanism, including a plurality of rotatable windings rotates about the vertical axis and wraps a wrap material about the rigid structure to reinforce the structure as it is being erected.

8 Claims, 6 Drawing Figures

EXTENSIBLE MAST

BACKGROUND OF THE INVENTION

1. Field of the Invention

This invention relates generally to extensible and retractable members and, specifically, to such members and a method of forming the same for use as rigid supports, as in the case of aerial masts and antennae.

Many types of extensible and collapsible members are known, such as antennae used in communication, support platforms used in harvesting fruit, brooms used in inspecting and servicing machinery, elevators for fire hoses, and the like.

The typical prior art device utilized a telescoping action which resulted in several inherent problems. These problems included the length of span and span strength, the support or reinforcement provided by adjacent spans, and the number of spans needed to effect a desired amount of extension.

There exists a need, therefore, for an extensible and collapsible member which is strong and rigid when extended and which is free from the problems associated with the prior art devices.

There exists a need for such an extensible and retractable member which is extended by orienting and successively uniting similar flexible strips of material which can be retracted by successively disassembling the same strips.

Another need which is met by the present invention is the provision of an extensible mast or antenna which is erectable from a portable base and which has a very small volume or bulk when retracted for ease of transport.

2. Summary of the Invention

The extensible member of the invention includes a plurality of tape reels mounted upon a base which are angularly oriented thereon with respect to a common, vertical axis. Each of the tape reels is adapted to receive a resilient metal tape having longitudinal edges, for winding and unwinding the tape. Guide means located on the base receive the respective longitudinal edges of the metal tapes and orient the tape, whereby the tapes are fed upwardly in planes parallel to the vertical axis and at an angle to each other to form a rigid structure.

Winding means on the base dispense a reinforcing winding simultaneously with the upward movement of the tapes for strengthening the rigid structure. Preferably, the winding means include a bevel gear driven by a main drive. The bevel gear has a ring gear mounted thereon which is driven by the bevel gear for rotation about the vertical axis. The ring gear carries a plurality of rotatable windings thereon. Each of the rotatable windings has a planetary gear surface for contacting the mating surface of a stationary sun gear mounted on the base. Movement of the main drive and, in turn, the bevel gear causes the winding to rotate about the vertical axis as the rigid structure is being erected to wrap the structure with a reinforcing winding.

Additional objects, features and advantages will be apparent in the written description which follows.

DETAILED DESCRIPTION OF THE INVENTION

Figure 1:
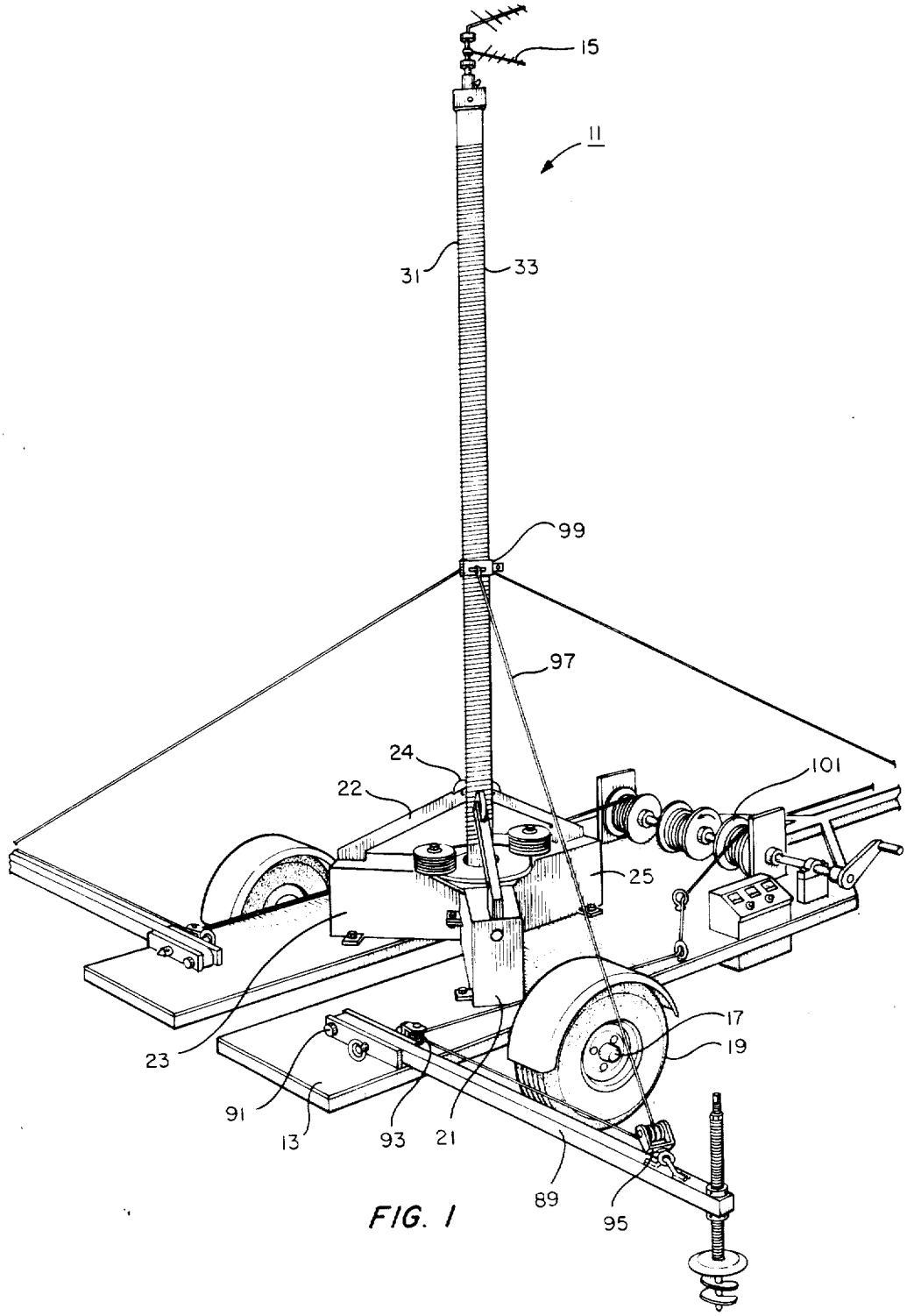
FIG. 1 is a perspective view of an extensible mast of the invention being erected from a portable base.

FIG. 1 shows an extensible mast 11 of the invention which has been erected from a movable base 13 to support an antenna 15. The base 13 is provided as a trailer having an axle 17, wheels 19 and having a conventional hitch (not shown) for towing behind a vehicle.

The base 13 has mounted thereon a plurality of tape reel housings 21, 23, 25 which are angularly oriented thereon with respect to a common, vertical axis. A support bar 22 and associated roller 24 is mounted on each housing. Each of the tape reel housings, e.g., 21 in FIG. 2, has rotatably mounted therein a tape reel 27 which is adapted to receive a resilient metal tape 29 having longitudinal edges 31, 33 (FIG. 1), for winding and unwinding the tape.

The tape 29 is preferably made of flat sheet steel which has previously been decoiled, straightened, and heat treated into a flattened position, and then recoiled onto a suitable reel of a sufficient diameter so as to allow stresses which will not permanently set the steel. The coil sheets may either be straightened into flat ribbons of steel or may be rolled into a flat ribbon configuration which is slightly concave before heat treating. The latter shape may resemble that of a steel tape measure, for example.

Each reel 27 is rotatably mounted upon a shaft 35 and has a free wheeling clutch and drag brake so that the tape 29 is at all times held tightly to the reels 27 and will not become decoiled on the reel.

The tape 29 is deployed from the reels 27 through a pair of pinch rollers 37, 39 which are ganged together in such a way as to deploy the tape from the three reels in a uniform manner. The pinch rollers include an idler 39 and a driven roller 37 which grip the tape tightly and pull the material from the reels 27, overcoming the force of the drag brake. Each set of pinch rollers 37, 39 is driven by means of a main drive gear 41 which is connected by a linkage 43 to the driven roller 37. Each main drive gear 41 has a toothed surface 45 which mates with the threaded surface 47 of a drive shaft 49. The source of driving power is not shown but any type of motorized drive shaft can be utilized. Preferably, the three drive shafts 49 would then be ganged together with a gearing system, so that as one reel 27 rotates, the other two reels rotate in identical fashion.

Figure 2:
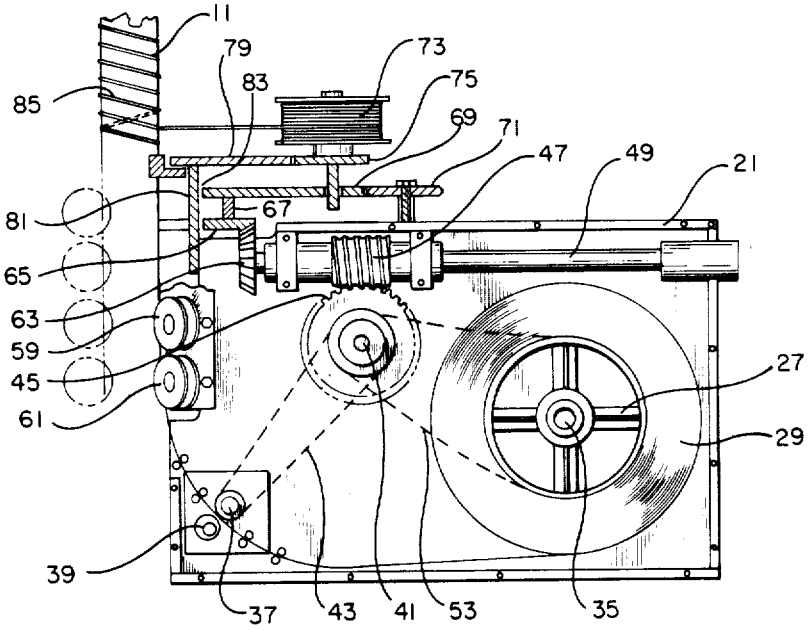
FIG. 2 is a side view of one of the tape reels of the mast of FIG. 1 with parts of the reel housing removed and part of the components sectioned for ease of illustration.
Figure 3:
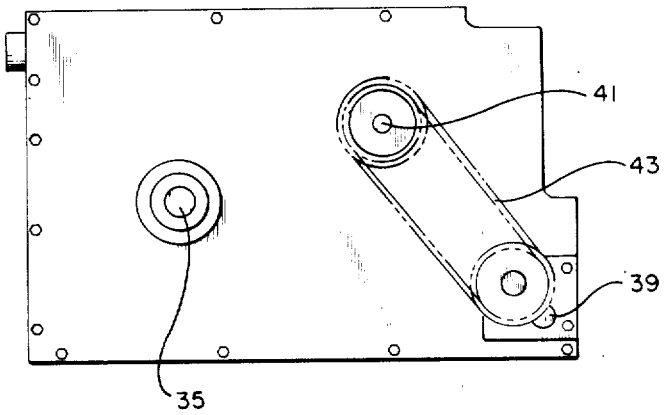
FIG. 3 is a side, perspective view of the opposite side of the reel housing of FIG. 2.

The main drive gear 41, as shown in FIG. 2, is also connected through a linkage 53 to the free wheeling clutch of the reel 27, so that when the pinch rollers are reversed to retract the mast, the reel 27 has a tendency to overrun and tightly rewind the tape.

The tape 29 is deployed from the reels 27 and passes through a guide means located on the base 13 for receiving the respective longitudinal edges 31, 33 for orienting the tapes. In this way, the tapes are fed upwardly in planes parallel to the vertical axis of the mast at an angle to each other to form a rigid structure. Preferably, the guide means comprises a plurality of guide rollers arranged on the base 13 for receiving the respective longitudinal edges of the metal tapes. As shown in FIG. 2, each tape housing 21 is preferably provided with one or more vertically aligned guide rollers 59, 61 for orienting the tape 29. Other guide means could be utilized, such as an equilateral, triangular mandrel for positioning the tape in a triangular shape.

The extensible mast is also provided with a winding means on the base 13 for dispensing a reinforcing winding simultaneously with the upward movement of the tapes 29 for strengthening the rigid structure. As shown in FIG. 2, the winding means can include a bevel gear 63 located on the drive shaft 49 which meshes with and drives a bevel gear 65. Gear 65 has teeth on its exterior and a central aperture through which mast 11 extends. The gear 65 has a plurality of bolts 67 which bolt the gear 65 to a rotatable plate 69. Three idler wheels 71 located on the tape housing 21 rotatably support the plate 69 about the peripheral edges thereof, and thus provide support for the bevel gear 65.

The plate 69 has mounted thereon one or more rotatable reels 73, preferably two. Each of the rotatable windings or reels 73 has a planetary gear 75 on its lower end which contacts and matingly engages the teeth on the exterior of a stationary sun gear 79. The sun gear 79 is stationarily mounted on a support member 81 which extends within a central opening 83 in the rotatable plate 69 and is mounted to housing 21.

Wrap material 85, wound around reels 73, can consist of thin aircraft cable, mylar or fiberglass tape, or other combinations of tape, wire or material suitable to bind the pieces of tape 29 together. For example, one reel 73 can contain tape, while the other winding contains wire, or both can contain tape or wire. The reels 73 have overunning means, described subsequently in connection with FIG. 6, to keep the wrapped material 85 tight as it spins around the mast 11 as the mast is being deployed from or retracted by the pinch rollers 37, 39.

The pinch rollers 37, 39 are provided with an opening means, such as lever (87 in FIG. 4) for temporarily opening the pinch rollers during the erection of the extensible mast 11, to thereby vary the number of windings applied per given length of the mast erected. Also, an adjustment means can be provided for varying the opening between the pinch rollers 37, 39, so that the friction drive can be adjusted to provide for a variation in tension of the tape 29.

One or more guy sets (89 in FIG. 1) can be mounted on the base 13 to provide additional stability for the mast 11. As the mast 11 is being deployed from the base 13, it will have sufficient stiffness until a given critical height is obtained. This height is chiefly a function of the wind velocity and the degree of incline of the base 13. As shown in FIG. 1, the guy 89 is pivotable about a point 91 on the base 13 and contains sheaves 93, 95 for routing the guy wires 97 between the base 13 and a bracket 99 fixed to the mast 11. The guy wires 97 are dispensed from one or more wire reels 101 carried on the base 13.

As many sets of guy wires 97 as are required can be deployed in an identical manner. Additionally, permanent guying can be provided by deploying the guy wires through spaced anchor footings placed on the ground. As soon as the tower is fully deployed, the guy wires would be permanently attached to the screw anchor footing.

A termination clamp, similar to bracket 99, can be provided as an option for use in case where it is desired to attach the deployed mast 11 to a permanent base frame. In this case, the mast material would be cut and the mast 11 would be removed from the deployment device. Permanent guying cables and anchors would also be used in this event.

Figure 6:
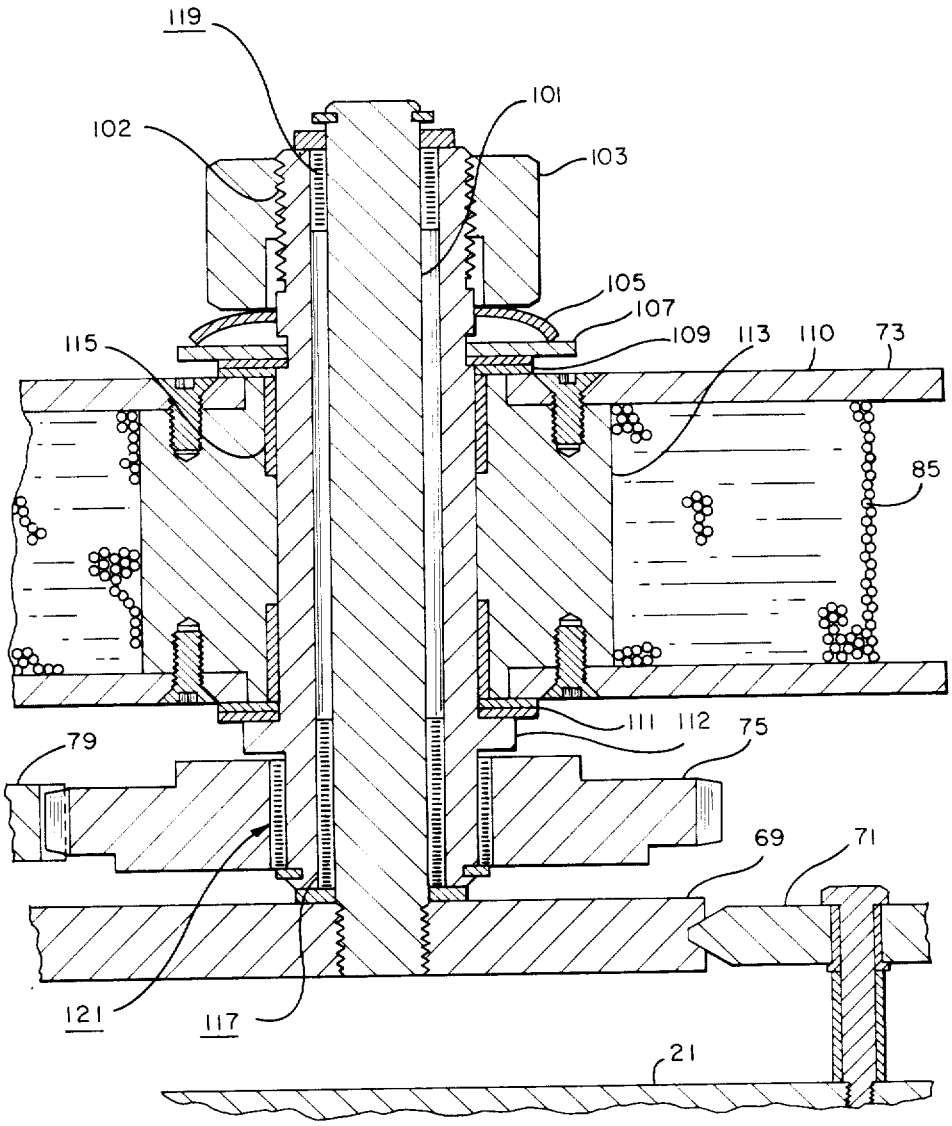
FIG. 6 is a vertical section view of one of the reels of the extensible mast.

FIG. 6 illustrates the overrunning clutch means for the reels 73. The assembly includes a stationary shaft 101 that is rigidly secured in rotating plate 69, so that it will rotate about the axis of the mast 11 with the plate 69. A cylindrical hub 102 is carried on the outside of the shaft 101. A nut 103 is secured to threads at the top of the hub 102. Nut 103, when tightened, bears against a bevel spring 105. Spring 105 bears against a tongue washer 107 that encircles the hub 102. Tongue washer 107 will move axially along the length of the hub 102. However, it is locked to the hub 102 for rotation therewith by inwardly protruding tabs located in slots in the hub 102.

Tongue washer 107 bears against a pair of hard, smooth surface washers 109. Washers 109 are located between the tongue washer 107 and the reel flanges 110. There is a second set of smooth hard surfaced washers 111 located on the lower side of the reel flanges 110, and spaced between the reel flange 110 and a flange 112 formed on the hub 102. Washers 109 and 111 are not rigidly locked to the hub 102 or the reel flanges 110, but cause the reel flanges 110 to rotate with the hub 102 due to frictional force from the bevel spring 105, until this frictional force is overcome. The reel flanges 110 are secured to a central cylinder 113, which has bronze bushings 115 on the inside for accommodating rotation of the reel 73 relative to the hub 102.

Upper and lower overrunning hub clutches 117 and 119 are located between the shaft 101 and the hub 102. Hub clutches 117 and 119 lock the hub 102 and the shaft 101 together when the hub 102 is being rotated in the direction that occurs while the mast 11 is moving upward. While the mast 11 is moving downward, the overrunning clutches 117 and 119 allow free rotation of the hub 102 with respect to the shaft 101. There is also an overrunning gear clutch 121 located between the gear 75 and the hub 102. Clutch 121 locks the gear 75 to the hub 102 when the gear 75 is being rotated in the direction while the mast is going down. When the mast is going up, the clutch 121 allows free rotation of the gear 75 relative to the hub 102. Clutches 117, 119 and 121 are conventional clutches which allow rotation in one direction, but prevent rotation in the opposite direction.

In the operation of the assembly shown in FIG. 6, referring also to FIG. 2, while the mast 11 is moving upwardly, the beveled gear 63 will rotate the beveled gear 65, which in turn rotates the plate 69, causing the reel 73 to orbit about the mast 11. The sun gear 79 is always stationary. The gear 75 rotates, but due to clutch 121, its rotation will have no affect on the hub 102. Also, the clutches 117 and 119 will lock the hub 102 to the shaft 101, which is stationary. The reel 73 will rotate only due to the wire 75 being pulled off and wrapped around the mast 11. To maintain tension, the bevel spring 85 pushes against the tongue washer 107, which in turn compresses the washers 109 and 111, providing a desired frictional force to cause the wire to tightly wrap.

When the mast is being retracted, referring to FIG. 2, the shaft 49 is rotated in the opposite direction, rotating the beveled gear 63 and 65 in the opposite direction. Plate 69 will thus rotate in the opposite direction with the gear 65. Reels 73 will orbit about the mast 11 in the opposite direction. Gear 75 will rotate due to its engagement with the stationary sun gear 79. This time, the gear clutch 121 locks the gear 75 to the hub 102 for rotation therewith. Conversely, the hub clutches 117 and 119, because of the reverse direction, allow free rotation of the hub 102 around the shaft 101. To assure that the line is pulled tightly around the reel 73 under the same tension that occurred while the line was being wound onto the mast 11, the gear ratio between the gear 75 and sun gear 79 is selected to rotate the reel 73 faster than it can draw the line 85 from the mast 11. It can draw the line 85 from the mast 11 only as the mast 11 moves downwardly since mast 11 does not rotate.

To prevent the line 85 from breaking, the bevel spring 105 provides frictional force on the washers 109 and 111 to allow the reel 73 to slip as the line 85 is wound about it. This slight slippage places the line under the same amount of tension that occurs when the line 85 was being wrapped around the mast 11. Consequently, reel 103 slides under friction due to the bevel spring 105 both while the cable 85 is being pulled from the reel 73, and also while the line 85 is being wrapped around the reel 73. Slippage of the reel 73 with respect to the hub 102 thus occurs in both directions. In one direction, the hub 102 will rotate, but at a faster rate than the reel 73 can rotate, while in the other direction, the hub 102 will not rotate.

Figure 4:
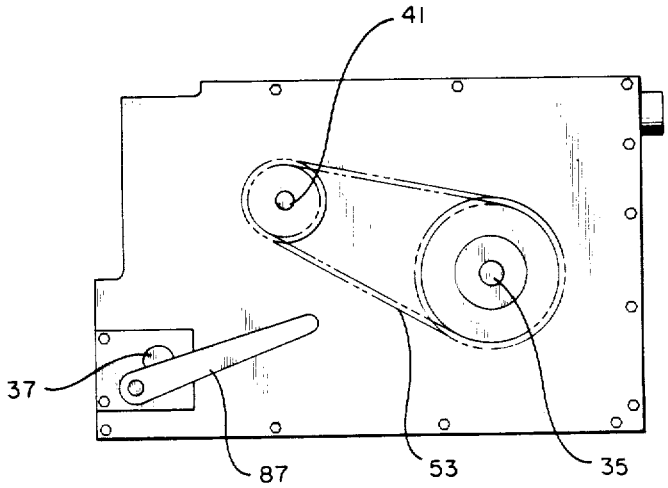
FIG. 4 is a side, perspective view of the reel housing of FIG. 2 with the side of the housing in place.
Figure 5:
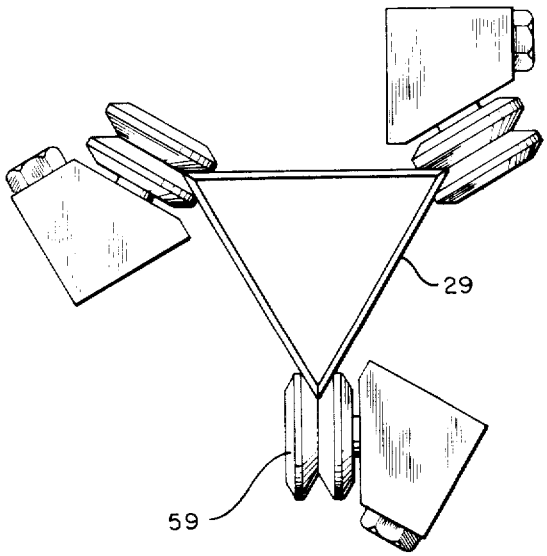
FIG. 5 is an isolated, top view of the guide rollers used to orient the tape fed from the tape reels.

The overrunning assembly shown in FIG. 6 is also used in the same fashion with the tape reels 27. The only differences are that instead of a gear 75, a sprocket will be used for engaging chain 53 (FIG. 4). Also, of course, instead of wire 85, the reel 27 is wrapped with the steel tape 29. This assembly thus provides the drag brake needed while the mast 11 is moving up, and the overrunning tension means needed to assure tight rewinding as the mast 11 is being retracted.

The overall operation of the extensible mast will now be described. As the drive shaft 49 is rotated, the threaded surface 47 drives the main drive gear 41, which acts through the linkage 43 to turn the driven roller 37 of the pinch roller set. This action frictionally engages and pulls the tape 29 and overcomes the drag brake mechanism of the reel 27 to dispense tape. The tape passes upwardly through the guide rollers 59, 61 and is oriented to form an equilateral triangle which is forced upwardly along a vertical axis. Movement of the drive shaft 49 causes the bevel gear 63 to drive the annular plate 65. As has been described, the movement of the annular plate 65 causes the reels 73 to spin about the stationary gear 79, so that the reels rotate about the vertical axis of the mast 11 to wrap the mast with a reinforcing winding 85 as the mast is being erected.

To retract the mast 11, the procedure is repeated in reverse. Reversing the direction of the drive shaft 49 acts through linkage 53 to drive the tape reel 27 and pull the tape 29 through the pinch rollers 37, 39 to retract the tape. This action also causes the rotatable winding 73 to turn in the opposite direction and rewind the wrap material 85 onto the respective reels.

An invention has been provided with several advantages. The extensible mast of the invention can be hauled to remote locations upon a portable base. The size and compact nature of the collapsed mast facilitate transportation. The reinforcing windings provide additional stability for the mast 11 which eliminates the need for extensive guying. The erection process is simply reversed to retract the mast and rewind the reinforcing wrap material.

While the invention has been shown in only one of its forms, it is not thus limited but is susceptible to various changes and modifications thereof.

I claim:

1. An extensible mast, comprising:

a plurality of tape reels mounted upon a base and angularly oriented thereon with respect to a common, vertical axis, each of said tape reels, receiving a resilient metal tape having longitudinal edges, for winding and unwinding said tape;

guide means located on said base receiving the respective longitudinal edges of said metal tapes and for orienting said tapes whereby said tapes are fed upwardly in planes parallel to said vertical axis and at an angle to each other to form a rigid structure; and winding means on said base dispensing a reinforcing winding simultaneously with the upwardly movement of said tapes for strengthening said rigid structure, said winding means including a bevel gear driven by a main drive, said bevel gear engaged with an annular plate having a ring gear mounted thereon which is driven by said bevel gear for rotation about said vertical axis, and wherein said ring gear carries a plurality of rotatable windings thereon, said rotatable windings having a planetary gear surface for contacting the mating surface of a stationary sun gear mounted on said base, whereby movement of said main drive and, in turn, said bevel gear causes said windings to rotate about said vertical axis as said rigid structure is being erected to wrap said structure with a reinforcing winding.

2. The extensible mast of claim 1, wherein said guide means comprises a plurality of guide rollers arranged on said base receiving the respective longitudinal edges of said metal tapes.

3. The extensible mast of claim 2, further comprising:

a pair of pinch rollers associated with each of said tape reels, each of said pinch rollers being driven by said main drive to pull said tape from said reels by frictional engagement.

4. The extensible mast of claim 3, further comprising:

opening means temporarily opening said pinch rollers during the erection of said rigid member, to thereby vary the number of windings applied per given length of said member erected.

5. The extensible mast of claim 4, further comprising:

a plurality of stabilizing rollers mounted on said base contacting the respective sides of said rigid structure as said structure is being erected.

6. The extensible mast of claim 5, further comprising at least one guy wire dispenser mounted on said base and a mounting member attaching an end of said wire to said rigid member.

7. An extensible mast, comprising:

a plurality of tape reels mounted upon a base and angularly oriented thereon with respect to a common, vertical axis, each of the tape reels receiving a resilient metal tape having longitudinal edges, for winding and unwinding the tape;

guide means located on said base receiving the respective longitudinal edges of the metal tapes and orienting the tapes;

means feeding the tapes upwardly in planes parallel to the vertical axis and at an angle to each other to form a rigid mast, and winding the tapes back on the tape reels to lower the mast;

at least one wrapping reel mounted above the base and containing a reinforcing winding;

means orbiting the wrapping reel about the mast as the mast moves upwardly and downwardly and dispensing and rewinding a reinforcing winding about the mast as the mast extends and retracts; and clutch and brake means applying a frictional resistance to the wrapping reel as the mast moves upwardly, drawing reinforcing winding from the wrapping reel under tension, and allowing frictional slippage of the wrapping reel as the reinforcing winding is drawn back onto the winding reel to assure rewinding under tension.

8. A method of erecting an extensible mast from a movable base, comprising the steps of:

mounting a plurality of tape reels on said base, said reels being angularly oriented on said base with respect to a common, vertical axis, each of said tape reels being adapted to receive a resilient metal tape having longitudinal edges, for winding and unwinding said tape;

mounting a plurality of guide rollers on said base for receiving the respective longitudinal edges of said metal tapes and for orienting said tapes;

feeding said tapes upwardly through said guide rollers in planes parallel to said vertical axis and at an angle to each other to form a rigid structure;

mounting at least one rotatable winding on said base for dispensing reinforcing winding and rotating said winding about said vertical axis as said tapes are fed upwardly along said vertical axis.

* * * * *